US009388675B2

(12) United States Patent
He

(10) Patent No.: US 9,388,675 B2
(45) Date of Patent: Jul. 12, 2016

(54) MULTI POWER LAUNCH SYSTEM FOR PRESSURE DIFFERENTIAL DEVICE

(71) Applicant: BAKER HUGHES INCORPORATED, Houston, TX (US)

(72) Inventor: Zhe Y. He, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 483 days.

(21) Appl. No.: 13/920,741

(22) Filed: Jun. 18, 2013

(65) Prior Publication Data

US 2014/0367115 A1 Dec. 18, 2014

(51) Int. Cl.

| | |
|---|---|
| ***E21B 34/08*** | (2006.01) |
| ***E21B 43/12*** | (2006.01) |
| ***E21B 34/06*** | (2006.01) |
| ***E21B 34/10*** | (2006.01) |
| *E21B 41/02* | (2006.01) |

(52) U.S. Cl.

CPC ..... *E21B 43/12* (2013.01); *E21B 34/063* (2013.01); *E21B 34/08* (2013.01); *E21B 34/10* (2013.01); *E21B 41/02* (2013.01)

(58) Field of Classification Search

CPC ..... E21B 34/10; E21B 34/063; E21B 34/08; E21B 34/14; E21B 2034/007

See application file for complete search history.

(56) References Cited

U.S. PATENT DOCUMENTS

| | | | | |
|---|---|---|---|---|
| 5,207,275 | A | 5/1993 | Strattan et al. | |
| 6,089,322 | A * | 7/2000 | Kelley | E21B 43/38 166/105.5 |
| 6,761,588 | B2 | 7/2004 | Heebe et al. | |
| 7,111,641 | B2 | 9/2006 | Marban et al. | |
| 2011/0030960 | A1 | 2/2011 | Fagley, IV et al. | |
| 2013/0048291 | A1 | 2/2013 | Merron et al. | |
| 2013/0112426 | A1 | 5/2013 | Frosell | |

FOREIGN PATENT DOCUMENTS

WO 2012136966 A2 10/2012

OTHER PUBLICATIONS

WO 2012/136966. Woodford, Kieth Donald. Filed Apr. 5, 2012. Published Oct. 11, 2012.*

* cited by examiner

*Primary Examiner* — Giovanna C Wright
*Assistant Examiner* — Tara Schimpf
(74) *Attorney, Agent, or Firm* — Mossman Kumar & Tyler PC

(57) ABSTRACT

An injection mandrel may include a valve controlling the flow of the injection fluid. A valve actuator operatively connected to the valve sequentially generates a first predetermined pressure and a larger second predetermined pressure in the valve. The valve actuator generates the second predetermined pressure in the valve in response to a predetermined change in a pressure at an annulus surrounding the mandrel.

17 Claims, 5 Drawing Sheets

MULTI POWER LAUNCH SYSTEM FOR PRESSURE DIFFERENTIAL DEVICE

BACKGROUND OF THE DISCLOSURE

1. Field of the Disclosure

This disclosure relates generally to oilfield operations and more particularly to injection and fluid processing systems and methods.

2. Background of the Art

During hydrocarbon recovery operations, it may be advantageous to treat a formation, a produced fluid, and/or downhole equipment with one or more chemical agents. These agents may be used to increase production rates, protect equipment, lengthen the productive life of a well, etc. Wells can produce useful hydrocarbons for decades. During this time, subsurface conditions may change. The present disclosure provides systems, methods, and device that can adapt to changing well conditions.

SUMMARY OF THE DISCLOSURE

In aspects, the present disclosure provides a system for injecting an injection fluid in a well. The system may include a pump that pumps the injection fluid via a supply line to an injection mandrel disposed in the well. The injection mandrel may include a valve controlling the flow of the injection fluid through the at least one injection mandrel, a valve actuator operatively connected to the valve, and an injection port that ejects the injection fluid out of the injection mandrel. The valve actuator sequentially generates a first predetermined pressure and a larger second predetermined pressure in the valve. The valve actuator generates the second predetermined pressure in the valve in response to a predetermined change in a pressure at an annulus surrounding the at least one injection mandrel.

In aspects, the present disclosure provides a method for injecting an injection fluid in a well. The method may include conveying the injection fluid through a supply line disposed in a well using a pump; receiving the injection fluid at an injection mandrel disposed in the well; controlling a pressure applied to the injection fluid in the injection mandrel using a valve; and controlling the valve with a valve actuator. The valve actuator may be configured to increase the applied pressure from a first predetermined pressure to a second predetermined pressure in response to a predetermined change in a pressure at an annulus surrounding the injection mandrel.

In aspects, the present disclosure further provides an apparatus for controlling flow of a fluid through a tool positioned in a well. The apparatus may include a valve controlling the flow of the fluid through the tool and a valve actuator operatively connected to the valve. The valve actuator sequentially generates a first predetermined pressure and a larger second predetermined pressure in the valve. The valve actuator generates the second predetermined pressure in the valve in response to a predetermined change in a pressure at a selected location in the well.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the one mode embodiments, taken in conjunction with the accompanying drawings, in which like elements have been given like numerals, wherein.

DETAILED DESCRIPTION OF THE DISCLOSURE

Embodiments of the present disclosure provide devices and methods that can store "spring power" downhole and release the spring power when needed. It should be understood that the use for stored spring power may arise at any stage of well construction or hydrocarbon production (e.g., drilling, evaluation, completion, recompletion, remediation, workover, etc.). Merely for brevity, the present disclosure will be discussed in the context of additive injection operations for oil wells with the understanding that the teachings of the present disclosure may be used in connection with any form of well tools. As wells goes deeper and deeper, the pressure differential becomes greater. For example, an initial well pressure may be 20,000 PSI at a selected pay zone. But after a few years, the pressure may decrease to 2,000 PSI. To effectively inject an additive into such a pay zone, it is desirable to make up for the pressure loss, which is 18,000 PSI (not counting friction, hydro static pressure, etc.). As will be described in greater detail below, devices according to the present disclosure can be selectively activated to achieve higher opening pressure in such situations.

Figure 1:
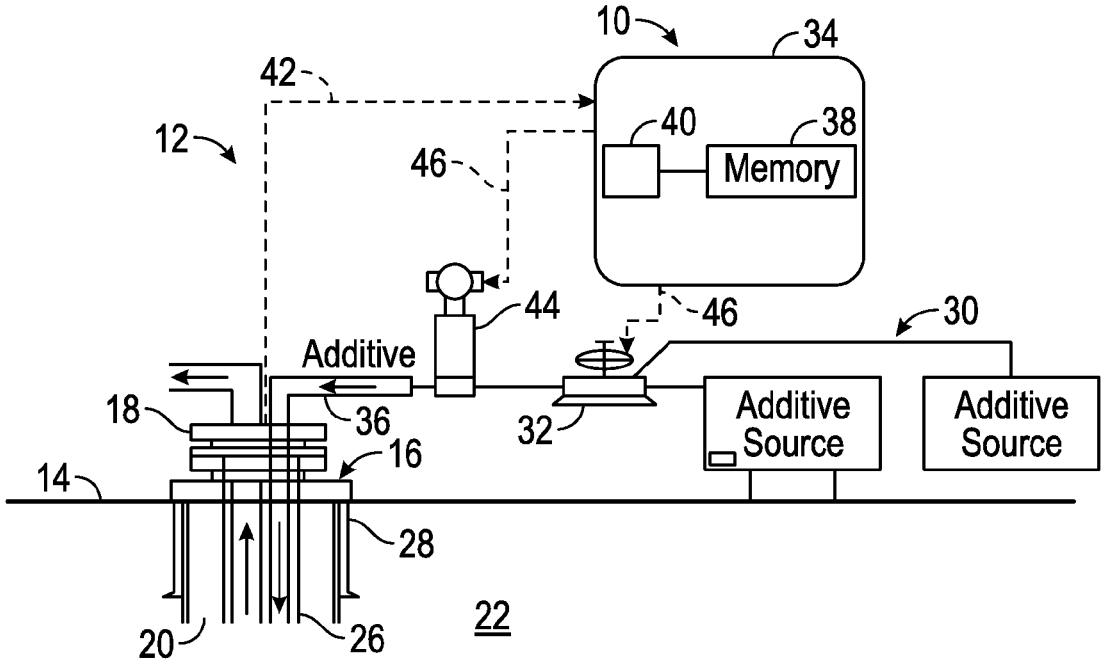
FIG. 1 schematically illustrates one embodiment of the surface components of an additive injection and monitoring system made according to the present disclosure.

Referring initially to FIG. 1, there is schematically shown one embodiment of an additive injection and monitoring system 10 (hereafter "system 10") made in accordance with the present disclosure. The system 10 may be deployed in conjunction with a facility 12 located at a surface 14 that services one or more production wells 16. While a land well is shown, it should be appreciated that the teachings of the present disclosure may be applied to offshore operations that service subsea wells. Conventionally, each well 16 includes a well head 18 and related equipment positioned over a wellbore 20 formed in a subterranean formation 22. The well bore 20 may have one or more production zones 24*a-d* (FIG. 2) for draining hydrocarbons from the formation 22 (FIG. 2) ("produced fluids" or "production fluid"). A production tubular 26 may be used to convey the fluid from the production zones to the wellhead 18. The production well 16 usually includes a casing 28 near the surface 14. The wellhead 18 may include equipment such as a blowout preventer stack and valves for controlling fluid flow to the surface 14. Wellhead equipment and production well equipment are well known and thus are not described in greater detail.

The system 10 may be utilized to introduce or inject a variety of chemicals or additives into the production well 16 to control, among other things, corrosion, scale, paraffin, emulsion, hydrates, hydrogen sulfide, asphaltenes, inorganics and other harmful substances. As used herein, the term "additive" generally refers to an engineered fluid that is formulated to perform a desired task. The additive(s) may be mixed with a base fluid such as water or oil to form what will hereafter be referred to as "injection fluid(s)." Injection fluid(s) may include liquids and/or gases. The system 10 may be configured to supply precise amounts of an additive or a mixture of additives to prevent, mitigate or otherwise lessen the harm caused by these substances. The system 10 may also be configured to periodically or continuously monitor the actual amount of the additives being dispensed, determine the effectiveness of the dispensed additives, and vary the amount of additives dispensed as needed to maintain one or more parameters of interest within predetermined ranges or at specified values.

In one embodiment, the system 10 may include an additive supply unit 30, an injector unit 32, and a controller 34. The system 10 may direct the injection fluid into a supply line 36 disposed inside or outside of the production tubular 26. The additive supply unit 30 may include multiple tanks for storing different chemicals and one or more pumps for pumping the additives. This supply of additives may be continuous or intermittent. The injector unit 32 selectively injects these additives into the production fluid. The injector unit 32 may be a pump such as a positive displacement pump, a centrifugal pump, a piston-type pump, or other suitable device for pumping fluid. The controller 34 may be configured to control the additive injection process by, in part, controlling the operation of the additive supply unit 30 and the injector unit 32. The controller 34 may control operations by utilizing programs stored in a memory 38 associated with the controller 34. The controller 34 may include a microprocessor 40 may have a resident memory, which may include read only memories (ROM) for storing programs, tables and models, and random access memories (RAM) for storing data. The models and/or algorithms stored in the memory 38 may be dynamic models in that they are updated based on the sensor inputs. The microprocessor 40 may utilize signals from downhole sensors received via line 42 and programs stored in the memory 38. Additionally, the controller 34 may transmit control signals to the injector unit 32 and other flow devices 44, such as flow metering devices, via suitable lines 46.

Figure 2:
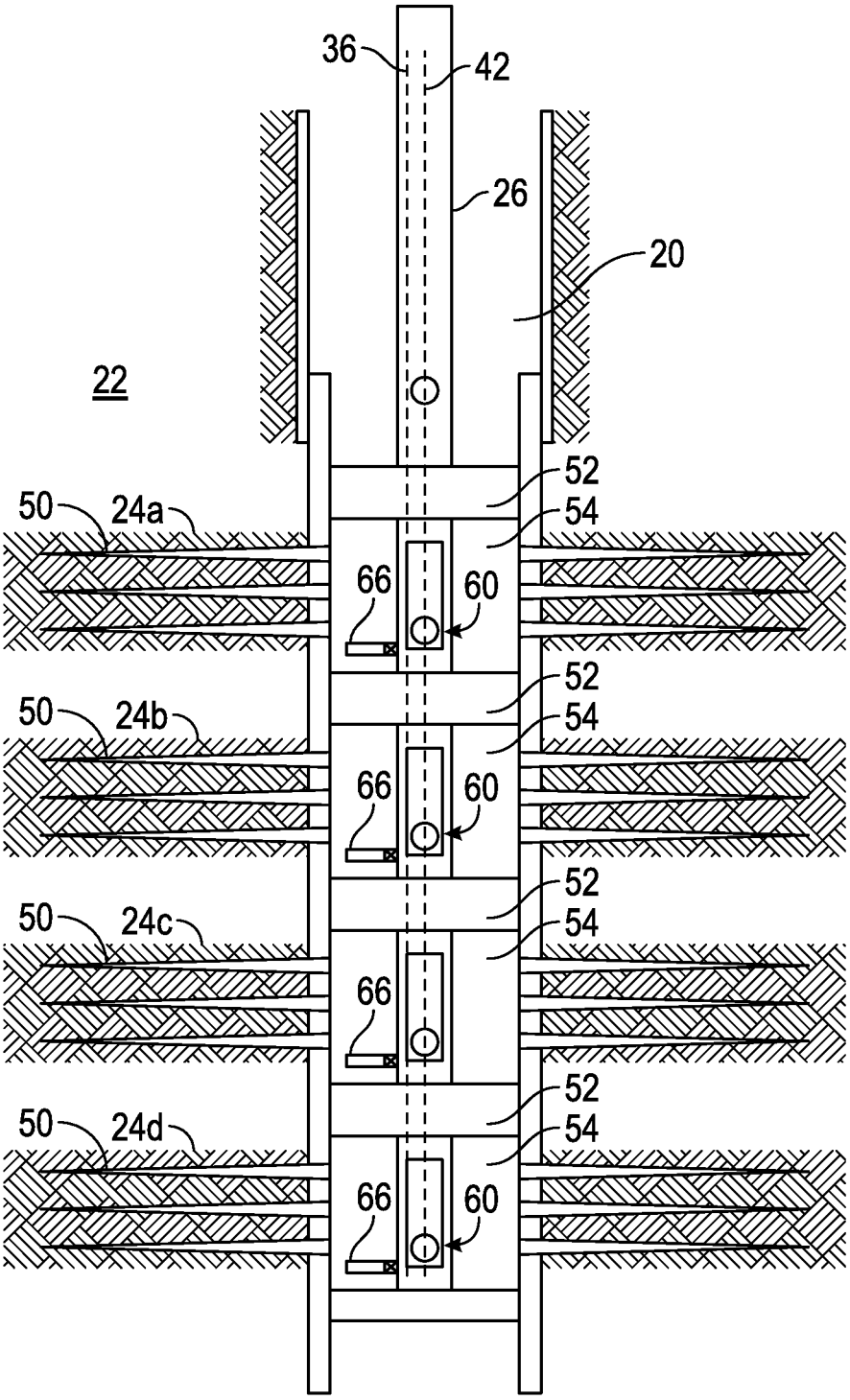
FIG. 2 schematically illustrates one embodiment of the subsurface components of an additive injection and monitoring system made according to the present disclosure.

Referring now to FIG. 2, the wellbore 20 is shown as a production well using conventional completion equipment. The wellbore 20 includes multiple production zones 24Aa-d, each of which that includes perforations 50 into the formation 22. Packers 52, which may be retrievable packers, may be used to provide zonal isolation for each of the production zones 24-*a-d*. Formation fluid enters the production tubing 26 in the well 16 via perforations 50. Each zone may include inflow control devices, screens, gravel packs or other to control flow at each of the zones 24A-D during the life of the well. Additionally, an injection mandrel 60 may be used to flow fluid from the tubing 26 into the formation; e.g., to test or treat the zone.

The injection mandrel 60 may include an injector nozzle 66 that receives an injection fluid from a supply line 36. The supply line 36 may be tubing, pipe, hose or other suitable device for conveying fluid. In one embodiment, the injector nozzle 66 may be configured as generally tubular members that direct the injection fluid into an annular region 54 (or annulus) of the zones 24*a-d* such that the injection fluid penetrates into the adjacent formation. In another embodiment, the injector nozzle 66 may direct the injection fluid into an annular region 54 of the zones 24*a-d* such that the injection fluid mixes with the production fluid and enters the injection mandrel 60 and production tubing 26.

Figure 3:
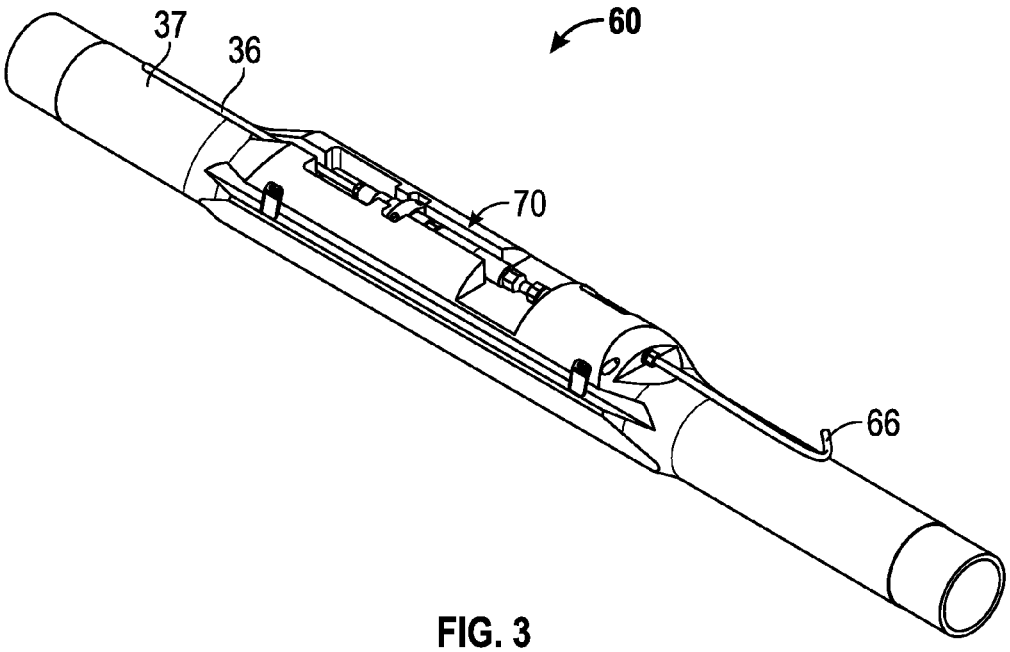
FIG. 3 schematically illustrates one embodiment of injection mandrel according to the present disclosure.
Figure 4:
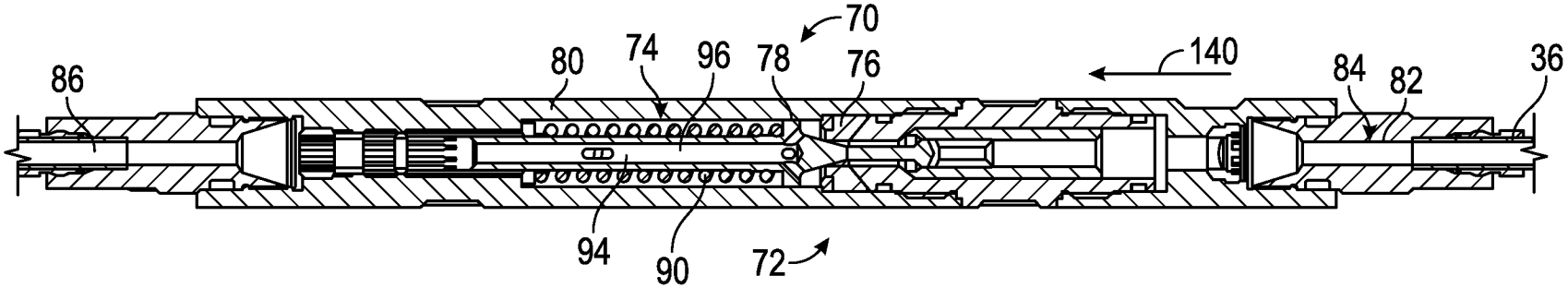
FIG. 4 schematically illustrates a valve assembly according to one embodiment of the present disclosure.

Referring now to FIG. 3, in one embodiment, the injection mandrel 60 may include a valve assembly 70 for controlling the injection of additives. The supply line 36 conveys fluid from the surface into the injection mandrel 60. A debris reducer 37 may be incorporated into the supply line 36. The debris reducer 37 may include rotating screens or filters to grind, cut and reduce the size of debris entrained in the flowing fluid. In an exemplary arrangement, the injection mandrel 60 may include a valve 72 (FIG. 4) controlling the flow of the injection fluid through the injection mandrel 60 and a valve actuator 74 (FIGS. 4 and 5) that controls the valve assembly 70 based on one or more predetermined operating parameters. For example, the valve actuator 74 (FIGS. 4 and 5) can actuate the valve assembly 70 (FIG. 4) to sequentially generate a first predetermined pressure and a larger second predetermined pressure in the valve assembly 70 (FIG. 4). The operating parameter may be pressure. The valve actuator 74 (FIGS. 4 and 5) can generate the second predetermined pressure in the valve assembly 70 in response to a predetermined change in a pressure at an annulus 54 (FIG. 2) surrounding the injection mandrel 60.

Referring now to FIG. 4, there is shown one embodiment of the valve assembly 70. The valve assembly 70 includes a housing 80 in which the valve 72 and some portions of the valve actuator 74 are enclosed. The housing 80 has an inlet 82 and fluid path 84 that is formed by a collection of bores and passages formed along the several components of the valve assembly 70. The fluid path 84 leads to an outlet 86. The valve 72 may include a valve seat 76 and a valve head 78. When the valve head 78 is seated against the valve seat 76, flow along the fluid path 84 is blocked. The spacing between the valve seat 76 and the valve head 78 may also be varied to control the pressure or flow rate along the fluid path 84.

The valve actuator 74 may include a first biasing member 90 that provides a continuous first biasing force to the valve head 78 and a second biasing member 92 (FIG. 5) that provides a selective second biasing force to the valve head 78. The biasing members 90, 92 may be one or more coil springs or other members having a module of elasticity suitable for generating a desired spring force when deformed (e.g., compressed). In other embodiments, the biasing member may be a compressed gas or liquid, a magnetic element, or other feature that can store energy that can be used to apply a biasing force. In one arrangement, a first shaft 94 may be used to translate the valve head 78. It should be understood that the first shaft 94 and the valve head 78 may be formed as an integral element or as separate elements. The first shaft 94 and the valve head 78 also include passage 96 that forms a portion of the fluid path 84. As shown, the first biasing member 90 may apply the biasing force directly by physically contacting the valve head 78 or by engaging a portion of the first shaft 94. In either instance, it should be appreciated that the first biasing member 90 may be configured to have a spring force that continuously urges the valve head 78 toward the valve seat 76.

Figure 5:
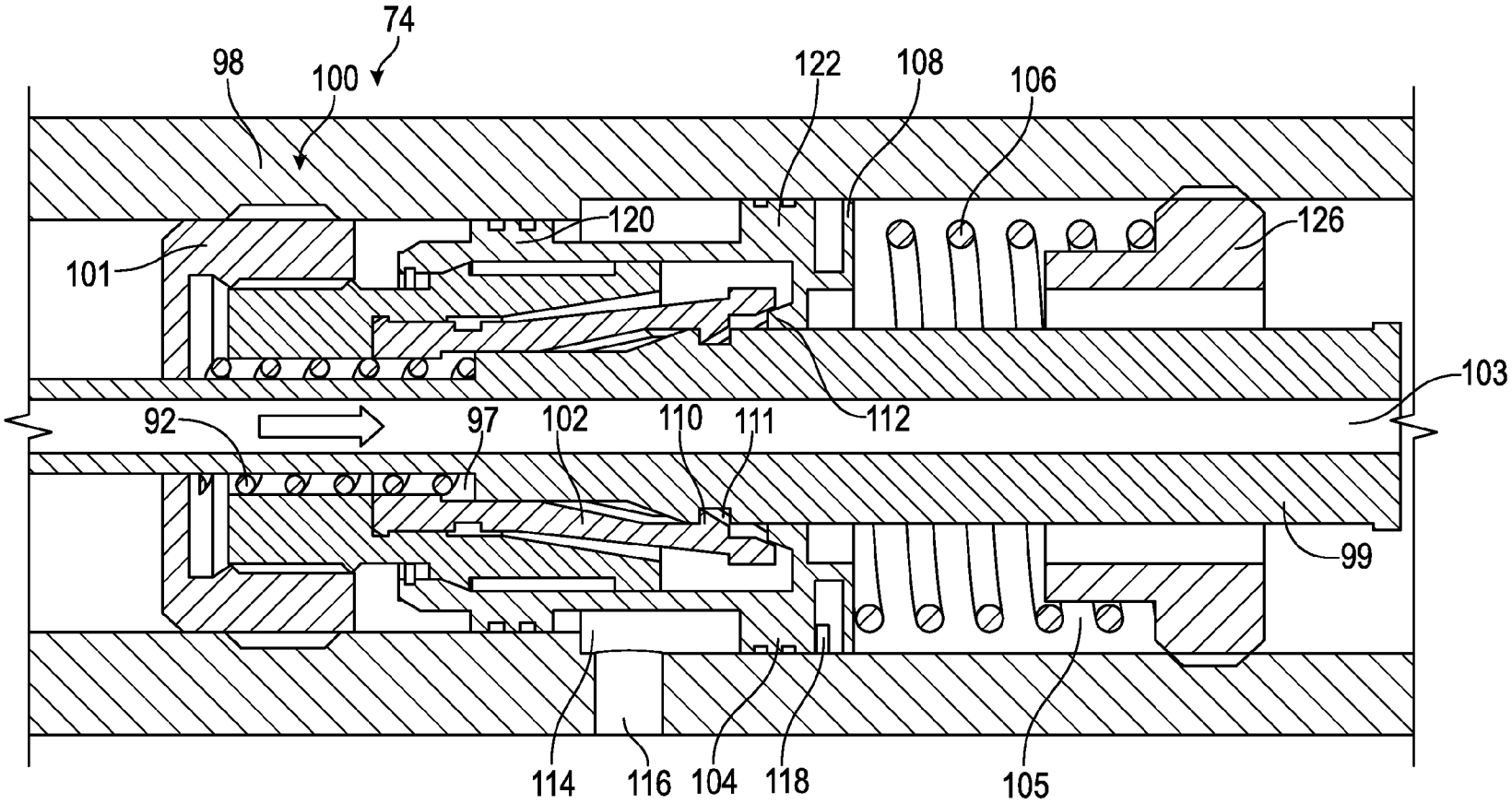
FIG. 5 schematically illustrates portions of a valve actuator according to one embodiment of the present disclosure.

Referring to FIG. 5, there are shown the features of the valve actuator 74 that provide a selective biasing force. As used herein, the term selective means that biasing force from the second biasing member 92 is applied to the valve head 78 (FIG. 3) only upon one or more pre-determined conditions occurring. In one arrangement, the valve actuator 74 includes a housing 98 in which is disposed a pressure-activated locking module 100 to selectively apply the biasing force of the second biasing member 92 to the valve head 78. The second biasing member 92 may be retained in a housing 101 and configured to generate a selective biasing force by engaging a shoulder or ledge 97 formed along a second shaft 99. The second shaft 99 includes a bore 103 that is in fluid communication with the fluid path 84 (FIG. 4). Thus, additive flows from the fluid path 84 (FIG. 4), through the bore 103, and to the nozzle 66 (FIG. 2). The second shaft 99 is axially aligned with and can slide into contacting engagement with the first shaft 94 (FIG. 4). When the first shaft 94 and the second shaft 99 are contacting, the second biasing member 92 can apply the biasing force to the valve head 78.

The locking module 100 may include a latch 102 and a sleeve 104 disposed on the second shaft 99. The latch 102 may be fixed to the housing 101 and the sleeve 104 may be generally free to slide within a bore 105 of the housing 96. Prior to activation, a frangible element 118 (e.g., a shear pin) retains the sleeve 104 in a stationary position in the locking module 100. The latch 102 may selectively connects to the second shaft 99 with one or more displaceable locking members 110. In one arrangement, the latch 102 may be a ring or tubular member that can radially expand. The locking member 110 may be a tooth or other projection that enters and mates with a complementary recess 111 in the second shaft 99. The sleeve 104 may include a projecting member 112 that engages with the latch 102. For example, the projecting member 112 may be formed as a wedge that enters into and radially expands the latch 102. This radial expansion disengages the locking member 110 from the recess 111.

The locking module 100 may be shifted from a locked state to an unlocked state by a third biasing member 106 and a pressure chamber 114. The third biasing member 106 may apply a biasing force to a contact face 108 formed on the sleeve 104. The pressure chamber 114 may be formed by inner surfaces of the housing 96 and the outer surfaces of the sleeve 104. A port 116 formed in the housing 98 can provide pressure communication between the pressure chamber 114 and the annulus 54 (FIG. 2) surrounding the injection mandrel 60 (FIG. 1). The annulus 54 is in hydraulic communication with the fluid in the formation. Therefore, changes in formation fluid pressure will be transmitted via the port 116 to the chamber 114.

It should be noted that the sleeve 104 has two opposing surfaces 120, 122 on which the hydrostatic pressure is applied. Surface 120 has less surface area than surface 122. Therefore, the hydrostatic pressure in pressure chamber 114 generates a net force that opposes a biasing force applied by the third biasing member 106 on the sleeve 104. The third biasing member 106 may be secured in the housing 96 with a fixed retainer 126. Thus, the third biasing member 106, which may be a spring or other similar element, can only expand in a direction toward the contact face 108. The frangible element 118 may be calibrated to break and release the sleeve 104 only when the biasing force applied by the third biasing member 106 exceeds the net force applied by the hydrostatic pressure in the pressure chamber 114 by a predetermined value.

The operation and use of injection mandrel 60 will be discussed with reference to FIGS. 1-5. FIGS. 4 and 5 show the valve assembly 70 in the pre-activated positions: there is no fluid pressure in the fluid line 36, the first biasing member 90 maintains the valve head 78 in a fluid tight sealing relationship with the valve seat 76; and the second biasing force generated by the second biasing member 92 is isolated from the valve head 78 because the sleeve 104 is locked to the second shaft 99. Also, the frangible element 118 prevents the biasing force of the third biasing member 106 from displacing the sleeve 104. The valve assembly 70 remains in these pre-activated positions at least until the injection mandrel 60 has been appropriately positioned in the wellbore 20.

After being installed in the wellbore 20, additive is pumped via the supply line 36 to the injection mandrel 60. The spring force of the first biasing member 90 is calibrated to require that the fluid pressure reach a predetermined opening pressure before the valve head 78 unseats from the valve seat 76. The opening pressure and the spring force are selected based on the ambient hydrostatic pressure of the wellbore then prevailing. Once the opening pressure is reached, the additive flow unseats the valve head 78 and flows through the fluid flow path 84, the bore 103, and out of the injection mandrel 60 via the nozzle 66. However, the first biasing member 74 continues to apply a back pressure to the flowing additive. This mechanically generated back pressure and the back pressure associated with the wellbore hydrostatic pressure enable the additive to be pressurized in the injection mandrel 60 and to be ejected out of the nozzle 66 with sufficient energy to penetrate into the surrounding formation a desired amount. While in the wellbore 20, the port 116 communicates hydrostatic wellbore pressure from the annulus 54 into the pressure chamber 114. The net force generated by this hydrostatic pressure and the frangible element 118 prevent the biasing force of the third biasing member 106 from moving the sleeve 104. Therefore, the locking member 110 remains seated in the complementary recess 111 and the second shaft 99 is stationary. In this state, the second biasing member 92 is functionally dormant (i.e., the spring force is stored and preserved).

Over time, the hydrostatic pressure drops, which then reduces the overall back pressure applied to the additive and reduces the degree to which the additive penetrates into the formation. As the annulus hydrostatic pressure drops, the net force generated by the fluid in the pressure chamber 114 also drops. As noted previously, the annulus 54 is in hydraulic communication with the fluid in the formation. Therefore, changes in formation fluid pressure will be transmitted to the chamber 104.

The biasing force of the third biasing member 106 is selected to break the frangible element 118 and axially displace the sleeve 104 once the annulus hydrostatic pressure drops below a preset value. When the sleeve 104 is so released, the projecting member 112 engages and expands the sleeve 104, which then pulls the locking member 110 out of the complementary recess 111. Now, the second shaft 99 is also free to axially translate and can be moved by the biasing force of the second biasing member 92. Once the second shaft 99 slides into engagement with the first shaft 94, the biasing force of the second biasing member 92 is applied to the valve head 78.

It should be appreciated that the biasing force now being applied to the valve head 78 has two sources: the first biasing member 90 and the second biasing member 92. Consequently, the back pressure to the additive in the injection mandrel 60 has been increased in an amount corresponding to the biasing force of the second biasing member 92. The increase in back pressure increases the required opening pressure and as noted previously increases the strength at which the additive is ejected from the injection mandrel 60.

It should be understood that the described embodiments are susceptible to numerous variations. For example, the valve actuator 74 can use several selectively activated biasing members that can be individually or collectively activated to release their respective stored spring forces. Moreover, in some embodiments, one or more of additional biasing members (not shown) can be arranged to counteract biasing forces and thereby reduce opening forces. Furthermore, while hydrostatic annulus pressure has been described as the pressure source used in connection with the activation of the valve actuator 74, it should be understood that the pressure for the chamber 114 can also be generated from the surface and transmitted to the injection mandrel 60 via tubing, control line, injection line. Thus, the valve actuator 74 may be activated using control signals transmitted from the surface. The control signal may be received at any selected location in the well (e.g., uphole of the injection mandrel, downhole of the injection mandrel, inside of the injection mandrel, outside of the injection mandrel, etc.). Additionally, it should be understood that some variants may be resettable. For example, a running tool (not shown) may be run into the wellbore 20 and used to reset the locking module 100 back to its original state.

As used above, the term "additive" generally refers to an engineered material that is formulated to perform a desired task. For example, an "additive" may be any material(s), agent(s) or substance(s) that interact with the downhole feature in a predetermined manner. An additive may be a gas, liquid, a gel, plasma, or a solid entrained in a fluid carrier. An additive may be chemically active (e.g., an acid), thermally active, electromagnetically responsive (e.g., magnetorheological fluids), mechanical (e.g., a proppant, gravel, cement, resin, etc.) or have specialized material properties (e.g., relative permeability modifiers). Also, merely for brevity, this disclosure refers to an "additive" in the singular. It should be understood that such references are inclusive of the plural "additives."

It should be understood that the described embodiments of the valve actuator may be used in any wellbore tool. Moreover, the wells need not be hydrocarbon producing wells. For example, the wells may be geothermal wells or water wells.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. A system for injecting an injection fluid in a well, comprising:

a pump;

a supply line disposed in the well and receiving the injection fluid from the pump; and at least one injection mandrel disposed in the well, the injection mandrel receiving the injection fluid from the supply line, the at least one injection mandrel including:

a valve controlling the flow of the injection fluid through the at least one injection mandrel, a valve actuator operatively connected to the valve, the valve actuator sequentially generating a first predetermined pressure and a larger second predetermined pressure in the valve, wherein the valve actuator generates the second predetermined pressure in the valve in response to a predetermined change in a pressure at an annulus surrounding the at least one injection mandrel, wherein the valve actuator includes a first biasing member and a second biasing member, the valve actuator using a biasing force of only the first biasing member to generate the first predetermined pressure, the valve actuator using the biasing force of the first biasing member and a biasing force of the second biasing member to generate the larger second predetermined pressure, and wherein the second biasing member is retained in a stationary state in the valve actuator until the predetermined change in the pressure at the annulus occurs; and an injection port ejecting the injection fluid out of the at least one injection mandrel.

2. The system of claim 1, wherein the valve actuator includes:

a valve head;

a first shaft engaging the valve head; and a second shaft selectively engaging the first shaft, wherein the first biasing member translates the first shaft to apply the first predetermined pressure to the valve head, wherein the larger second predetermined pressure is applied to the valve head after the second biasing member translates the second shaft into engagement with the first shaft, wherein the first biasing member translates the first shaft in the same direction as the second biasing member translates the second shaft.

3. The system of claim 2, further comprising a locking module in which the second biasing member is disposed, the locking module including:

a latch selectively connected to the second shaft, the latch including a displaceable locking member;

a sleeve disposed on the second shaft, the sleeve including a projecting member engageable with the displaceable locking member;

a third biasing member applying a biasing force to a contact face of the sleeve;

a pressure chamber at least partially surrounding the sleeve, the pressure in pressure chamber opposing the biasing force of the third biasing member;

a port providing pressure communication between the pressure chamber and the annulus surrounding the injection mandrel; and a frangible element selectively retaining the sleeve in a stationary position in the locking module, wherein the frangible element is calibrated to break and release the sleeve when the pressure in the pressure chamber drops below a preset value.

4. The system of claim 3, wherein the displaceable locking member is radially expandable, and wherein engagement between the projecting member and the locking member disconnects the latch from the second shaft.

5. The system of claim 1, further comprising a debris reducer receiving the injection fluid from the supply line, the debris reducer configured to reduce the size of debris entrained in the injection fluid.

6. The system of claim 1, wherein the valve actuator includes a valve head, and wherein the first biasing member and the second biasing member apply respective biasing forces in the same direction to the valve head.

7. A method for injecting an injection fluid in a well, comprising:

conveying the injection fluid through a supply line disposed in a well using a pump;

receiving the injection fluid at at least one injection mandrel disposed in the well;

controlling a pressure applied to the injection fluid in the at least one injection mandrel using a valve;

controlling the valve with a valve actuator, wherein the valve actuator includes a first biasing member and a second biasing member, wherein the valve actuator is configured to increase the applied pressure from a first predetermined pressure to a second predetermined pressure in response to a predetermined change in a pressure at an annulus surrounding the at least one injection mandrel;

generating the first predetermined pressure the valve actuator using a biasing force of only the first biasing member;

retaining the second biasing member in a statinary state in the valve actuator until the predetermined change in the pressure at the annulus occurs; and using the biasing force of the first biasing member and a biasing force of the second biasing member to generate the larger second predetermined pressure the predetermined change in the pressure at the annulus occurs.

8. The method of claim 7, wherein the valve actuator includes:

a valve head;

a first shaft engaging the valve head; and a second shaft selectively engaging the first shaft, wherein the first biasing member translates the first shaft to apply the first predetermined pressure to the valve head, and wherein the larger second predetermined pressure is applied to the valve head after the second biasing member translates the second shaft into engagement with the first shaft.

9. The method of claim 8, further comprising a locking module in which the second biasing member is disposed, the locking module including:

a latch selectively connected to the second shaft, the latch including a displaceable locking member;

a sleeve disposed on the second shaft, the sleeve including a projecting member engageable with the displaceable locking member;

a third biasing member applying a biasing force to a contact face of the sleeve;

a pressure chamber at least partially surrounding the sleeve, the pressure in pressure chamber opposing the biasing force of the third biasing member;

a port providing pressure communication between the pressure chamber and the annulus surrounding the injection mandrel; and a frangible element selectively retaining the sleeve in a stationary position in the locking module, wherein the frangible element is calibrated to break and release the sleeve when the pressure in the pressure chamber drops below a preset value.

10. The method of claim 9, wherein the displaceable locking member is radially expandable, and wherein engagement between the projecting member and the locking member disconnects the latch from the second shaft.

11. The method of claim 7, further comprising reducing a size of debris entrained in the injection fluid using a debris reducer receiving the injection fluid from the supply line.

12. An apparatus for controlling flow of a fluid through a tool positioned in a well, comprising:

a valve controlling the flow of the fluid through the tool; and a valve actuator operatively connected to the valve, the valve actuator sequentially generating a first predetermined pressure and a larger second predetermined pressure in the valve, wherein the valve actuator generates the second predetermined pressure in the valve in response to a predetermined change in a pressure at a selected location in the well, wherein the valve actuator includes a first biasing member and a second biasing member, the valve actuator using a biasing force of only the first biasing member to generate the first predetermined pressure, the valve actuator using the biasing force of the first biasing member and a biasing force of the second biasing member to generate the larger second predetermined pressure, and wherein the second biasing member is retained in a stationary state in the valve actuator until the predetermined change in the pressure at the annulus occurs.

13. The apparatus of claim 12, wherein the valve actuator includes:

a valve head;

a first shaft engaging the valve head; and a second shaft selectively engaging the first shaft, wherein the first biasing member translates the first shaft to apply the first predetermined pressure to the valve head, and wherein the larger second predetermined pressure is applied to the valve head after the second biasing member translates the second shaft into engagement with the first shaft.

14. The apparatus of claim 13, further comprising a locking module in which the second biasing member is disposed, the locking module including:

a latch selectively connected to the second shaft, the latch including a displaceable locking member;

a sleeve disposed on the second shaft, the sleeve including a projecting member engageable with the displaceable locking member;

a third biasing member applying a biasing force to a contact face of the sleeve;

a pressure chamber at least partially surrounding the sleeve, the pressure in pressure chamber opposing the biasing force of the third biasing member;

a port providing pressure communication between the pressure chamber and the selected location; and a frangible element selectively retaining the sleeve in a stationary position in the locking module, wherein the frangible element is calibrated to break and release the sleeve when the pressure in the pressure chamber drops below a preset value.

15. The apparatus of claim 14, wherein the displaceable locking member is radially expandable, and wherein engagement between the projecting member and the locking member disconnects the latch from the second shaft.

16. The apparatus of claim 12, further comprising a debris reducer receiving the fluid from the supply line, the debris reducer configured to reduce the size of debris entrained in the fluid.

17. The apparatus of claim 12, wherein the selected location is an annulus around the well tool, the annulus being in pressure communication with a fluid in the formation.

* * * * *